United States Patent [19]

Simon

[11] Patent Number: 5,052,568

[45] Date of Patent: Oct. 1, 1991

[54] TIGHT CLOSING DEVICE FOR CONTAINERS, AND A PROCESS FOR MAKING IT

[76] Inventor: Patrick Simon, 7 rue Théophile Gautier, 95140 Garges Les Gonesse, Val d'Oise, France

[21] Appl. No.: 499,836

[22] Filed: Mar. 27, 1990

[30] Foreign Application Priority Data

Mar. 28, 1989 [FR] France ..... 89 03996

[51] Int. Cl.[5] ..... B65D 51/18

[52] U.S. Cl. ..... 215/250; 215/317; 220/254; 220/258; 220/265; 220/634

[58] Field of Search ..... 215/200, 226, 258, 277, 215/317, 318, 320, 334, 347, 349, 350, 352, 250, 263, 321; 220/200, 254, 256, 258, 634, 265

[56] References Cited

U.S. PATENT DOCUMENTS

| | | | |
|---|---|---|---|
| 3,419,181 | 12/1968 | Stec | 220/258 |
| 3,871,545 | 3/1975 | Bereziat | 215/249 |
| 4,094,460 | 6/1978 | Scauga et al. | 229/43 |
| 4,133,447 | 1/1979 | Bouchet | 220/258 |
| 4,157,765 | 6/1979 | Golebiewsky | 220/265 |
| 4,362,250 | 12/1982 | Cottingham | 215/247 |
| 4,453,646 | 6/1984 | Harrild | 220/258 |
| 4,466,553 | 8/1984 | Zenger | 220/461 |
| 4,682,702 | 7/1987 | Gach | 215/232 |
| 4,909,434 | 3/1990 | Jones et al. | 229/125.15 |
| 4,934,585 | 6/1990 | Reil | 229/106 |
| 4,964,562 | 10/1990 | Gordon | 229/125.15 |

*Primary Examiner*—Stephen Marcus
*Assistant Examiner*—Stephen Cronin
*Attorney, Agent, or Firm*—Browdy and Neimark

[57] ABSTRACT

The device comprises a sheath in a synthetic material and including at least one protruding abutment for a latching on a neck of a container and a fitting collar for a portion of this neck. The sheath has a top provided with a sealing foil and is fitted inside a lid including fixation means associated with retainer members for the sheath. A space is defined between the sheath and the lid for accommodating a resilient deformation of the protruding abutment.

9 Claims, 2 Drawing Sheets

FIG. 1
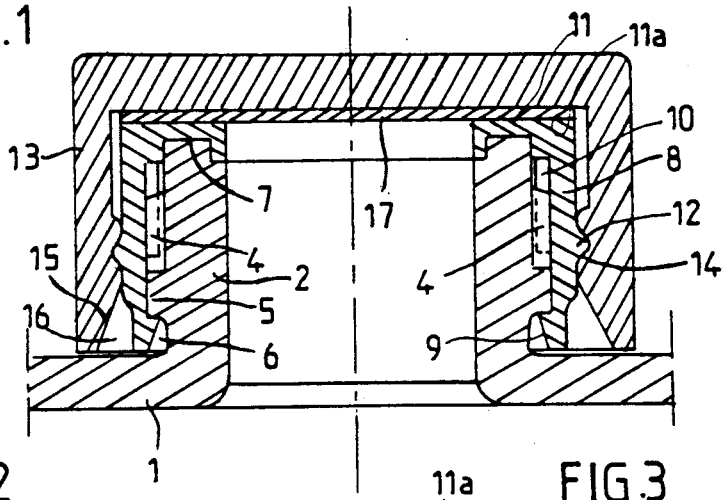
FIG. 2
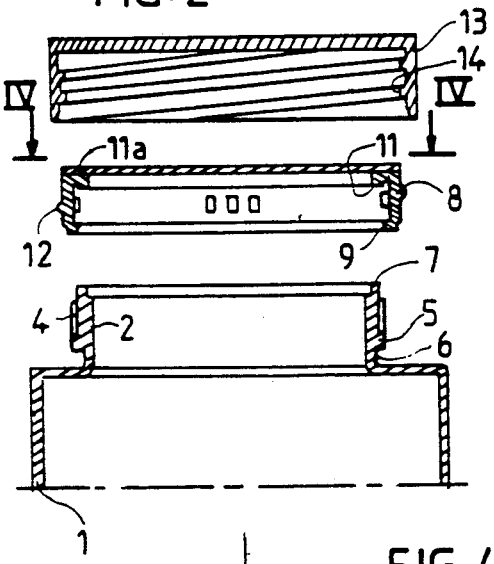
FIG. 3
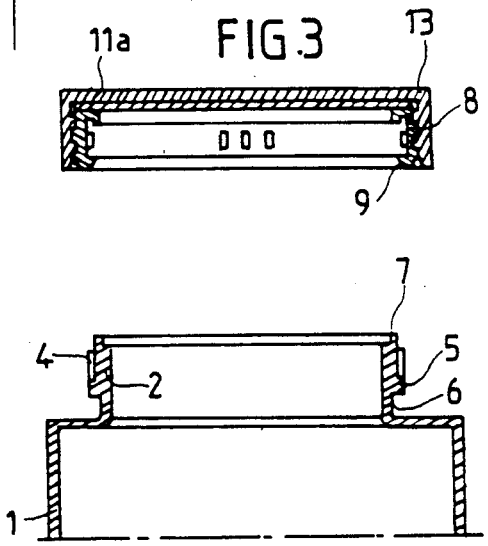
FIG. 4
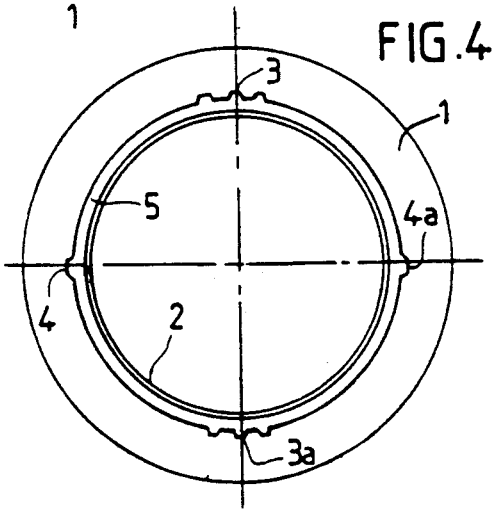
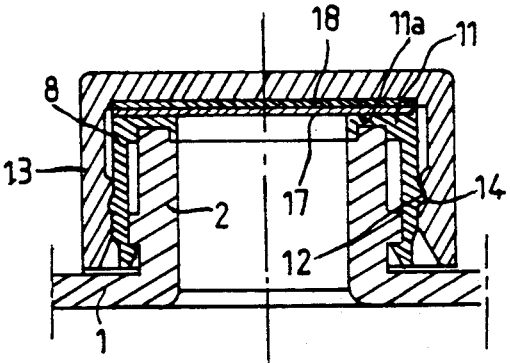
FIG. 5

TIGHT CLOSING DEVICE FOR CONTAINERS, AND A PROCESS FOR MAKING IT

FIELD AND BACKGROUND OF THE INVENTION

A very large number of products are offered for sale in containers having a neck the opening of which is provided with a sealing foil made of aluminum or aluminum-plastics material composite, for example an aluminum-polyethylene; this foil is welded or glued to a bonding material which is previously laid on top of the container neck when the container is in glass, in porcelain, or even in some types of synthetic materials such as melamines.

Thus, it is necessary to first of all deposit an adhesive material on top of the neck, then to provide a sealing pellet, to weld or fix in any other way this sealing pellet by application of heat in order to set the glue, or by application of a high frequency current or still by using any other means appropriate for the products in contact, and thereafter a lid has to be put in position on the neck.

The hereabove operations are rendered particularly complex since it is necessary to work in a sterile atmosphere, and most often even in a vacuum chamber.

There is thus used complex installations which are commercially interesting only for the manufacture of products in very large quantities as this is the case for example for the conditioning of pots for lyophilized products such as coffees.

The above mentioned complex installations cannot be suitably used when only small series of containers have to be conditioned, since the cost price and therefore the marketing price of the products would be considerably increased.

The invention solves the problem exposed hereabove by providing a new tight closing device.

SUMMARY OF THE INVENTION

According to the invention, the tight closing device for containers having a neck, comprises a sheath in a synthetic material, the sheath having retainer element and including at least one protruding abutment for latching on the sheath the neck of the container and a fitting collar for a portion of the neck, the sheath having a top provided with a sealing foil, and wherein the sheath is fitted inside a lid including fixation means associated with the retainer members of the sheath so as to provide successive removal and setting in position operations of this lid independently of the sheath, an annular space being defined between the sheath and the lid for accommodating a resilient deformation of the protruding abutment, and wherein said neck is formed with a set of teeth cooperating with a set of ribs formed by an inner wall of the sheath.

The invention is also extended to a method for manufacturing the hereabove tight closing device.

According to this second arrangement, the method for manufacturing a tight closing device comprises the steps of (i) making a by-product formed of a synthetic material sheath conformed so as to have a base including an annular abutment and an upper portion including a fitting collar and a top on which is sealed a tight foil; and (ii) assembling this by-product with a lid which surrounds it at least partially, which defines a space opposite the annular abutment and which is shaped so as to define retainer members complementary to fixation means of the sheath, so as form a sub-assembly brought to a workshop where the containers are filled and where this sub-assembly is put in position on the neck of the so filled containers by a simple fitting operation.

Various other features of the invention will become more apparent from the following detailed description.

BRIEF DESCRIPTION OF THE DRAWINGS

Embodiments of the invention are shown by way of non limiting examples in the accompanying drawings, wherein:

FIG. 1 is an elevation cross-sectional view of the neck of a pot or flask including the tight closing device of the invention;

FIG. 2 is an exploded cross-sectional view corresponding to FIG. 1 and illustrating the various closing members, as well as one of the steps of the method for making the closing device;

FIG. 3 is an exploded cross-sectional view similar to FIG. 2 and illustrating another production step;

FIG. 4 is a plane view shown in direction of line IV—IV of FIG. 2, with a covering foil not shown;

FIG. 5 is an elevation cross-sectional view similar to FIG. 1 illustrating a slight variant;

DESCRIPTION OF PREFERRED EMBODIMENTS

Figure 6:
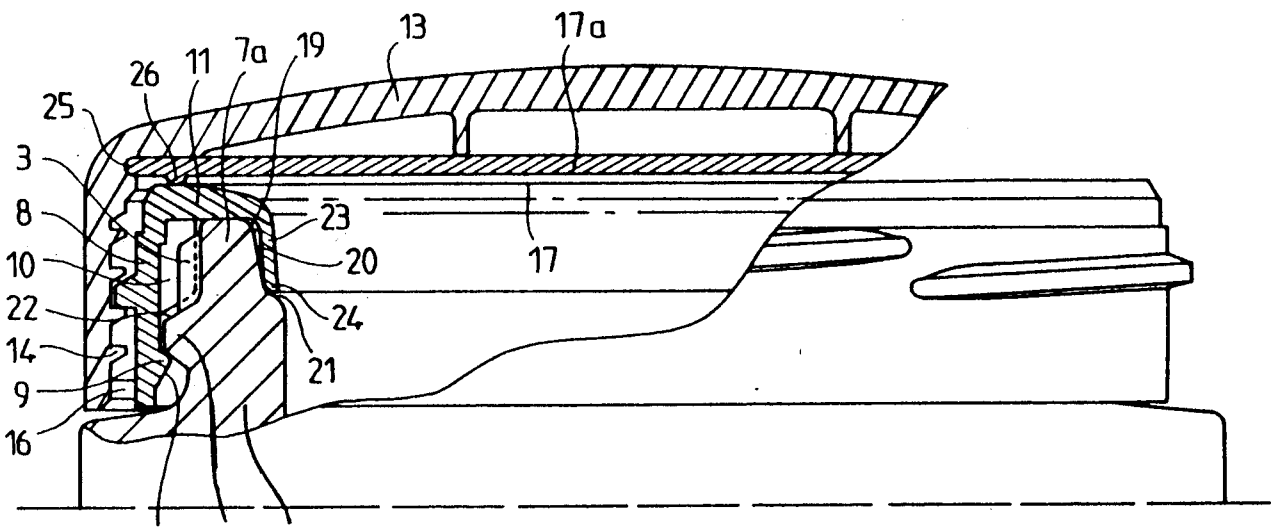
FIG. 6 is an elevation view partly cut out of a variant.

In the drawings, reference numeral 1 shows a pot or flask, or any other container including a neck 2. Preferably, the container 1 which will be referred to as a pot in the following disclosure is in glass, and its neck 2 has a wide opening for providing an easy access to the product contained therein, which can for example be a lyophilized coffee, a cosmetic product, and the like.

The glass pot 1 is made by molding in two half-shells, this making possible to provide, directly on the neck 2, of the pot 1 (see FIG. 4) two sets of teeth 3, 3*a* in an axial direction corresponding to the bottom of each of the two molding half-shells and, for example, two extra teeth 4, 4*a* corresponding to a junction line of the two half-shells.

The molding method makes also possible to provide a flange or ring 5 near the base of the neck 2, thus defining a groove 6 at the base of the neck 2.

Moreover, this molding method enables obtaining a protruding ring 7, at the top of the neck 2.

A second member of the closing device of the invention is made of a sheath 8 which comprises, at its base and starting from its inner wall, a protruding annular abutment 9 having a height which corresponds substantially to that of the groove 6 at the base of the neck 2, but is preferably slightly smaller than the groove 6.

The drawings show that the inner wall of the protruding abutment 9 is of a frustoconical shape.

The sheath 8 includes also, starting from its inner wall, a set of ribs 10 which are intended for being inserted between the sets of teeth 3, 3*a* and to sit on the teeth 4, 4*a* while surrounding them.

The ribs 10 as well as the teeth 3, 3*a* ... can possibly be formed on a whole inner periphery of the sheath 8 so that the latter can be put in position without having to chose a preferential position.

On its top, the sheath 8 forms a fitting collar 11 which is shaped precisely in the same manner as the protruding ring 7 of the neck 2.

Outside, the sheath 8 includes retainer members 12 of the screw thread type or similar for retaining a lid 13 including fixation means 14, for example inner screw thread or recesses, corresponding to the retainer members 12.

The end portion of the inner wall the lid 13 defines an edge 15 which is of a frustoconical or otherwise flare shape for defining an annular space 16 accommodating the resilient deformation of the protruding annular abutment 9 formed at the base of the sheath 8.

The sheath 8 is made of a synthetic material, for example polyethylene or a similar material, and the same generally applies to the lid 13, although the material constituting the lid 13 is completely irrelevant to the invention, as is also its outer shape.

Thus, it would be possible to make the lid 13 of wood or metal, and its outer shape could correspond or not to that of the pot 1. Only its inner wall must comprise the means described in the foregoing disclosure.

For the manufacture of the device, one proceeds as follows.

One produces the sheath 8 by molding, through injection or any other means, and one provides the top of its collar 11 with a sealing foil 17, for example in aluminum, aluminum coated with polyethylene or, also as shown in FIG. 5, an aluminum foil which is in turn glued or bonded to a sheet 18 in cardboard, plastics material or carboard impregnated with a plastics material.

The sealing foil 17 is fixed in a tight and unremovable manner on the top 11*a* of the fitting collar 11, typically by glueing, high frequency welding or any other suitable means, which provides for its definitive fixation.

The assembly formed by the sheath 8 and sealing foil 17 and/or the assembly formed by the sheath 8, sealing foil 17 and sheet 18, forms a by-product which can be made in specialized premises in order to be manufactured in very large production.

The pot 1 as well as the lid 13 are made independently in premises which can be distinct.

A following manufacturing operation consists in putting in position the sheath 8 provided with its sealing foil 17 inside the lid 13, and this can be easily done mechanically since the lid 13 and the sheath 8 can be assembled either by clipping or by screwing. The only measure of precaution which is to be taken is to ensure permanently the cleanliness and possibly the sterility of the sheath 8 and of the sealing foil 13. All the hereabove operations are of course carried out under atmospheric atmosphere.

The sheath 8-lid 13 sub-assemblies can then be supplied to the workshop or to the specialists in charge of the filling of the pots 1 who will only need, at end of the filling line, a machine for putting in position a sheath 8-lid 13 sub-assembly.

Actually, this sub-assembly can be put in position by a simple fitting engagement on the neck 2 of the pot 1, this fitting engagement causing, at end of the stroke, a momentaneous flaring out of the protruding annular abutment 9 which thereafter latches the sheath 8 and the ring 5, while the fitting collar 11 will cover the protruding ring 7 of the neck 2 and provides an absolute tightness between these members.

Figure 7:
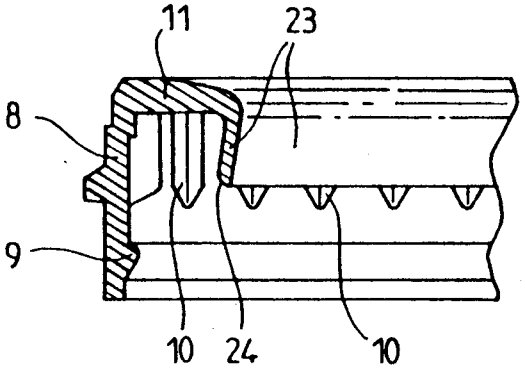
FIG. 7 is a partial transverse sectional view of a sheath including the closing device of the preceding figures.

In FIGS. 6 and 7, the same reference numerals designate the same members as in the preceding figures.

The neck 2 includes, as previously, a protruding ring 7*a* having an inner wall which defines a chanfer 19 extended by a slanting annular land 20 leading to a curved shoulder 21.

The outer land of the neck 2 includes also a set of teeth 3 extending above the ring 5.

The upper edge of the ring 5 is inclined in order to form a ramp 22 intended for cooperating with the inclined ramp 9*a* of the protruding annular abutment 9 of the sheath 8.

FIG. 7 shows that prior to being put in position on the neck 2, the sheath 11 includes an inner skirt 23 which is formed so as to converge toward the inside, meaning that this inner skirt 23 seems to be re-entrant, and it ends into a bevel 24. Thus, at the moment when the sheath 8-sealing foil 17-lid 13 assembly is threaded onto the neck 2, the bevel 24 first bears on the chanfer 19, then is guided by the inclined annular land 20 of the protruding ring 7, the effect of this being to deform the inner skirt 23 and to clamp it resiliently against the inclined annular land 20. There is thus obtained an excellent tightness between the sheath 8 and the neck 2.

FIG. 6 shows another development according to which the sealing foil 17 is covered by a tight seal 17*a* engaged via its periphery into a groove 25 of the lid 13. The seal 17*a* has advantageously an annular bead 26 which is clamped on the foil 17 and, after its removal, on the fitting collar 11 of the sheath 8.

The foregoing disclosure shows that, in the same manner as in the first embodiment, the teeth 3 of the neck 2 and the ribs 10 of the sheath 8 preclude any rotation of the sheath 8 about the neck 2 during the successive setting in position and removal operations of the lid 13, the ribs 10 having moreover for their function to increase the inertia moment of the outer portion of the sheath 8 and of its fitting collar 11, that is to say to stiffen them while providing measures so that the sheath 8 becomes practically not dismountable when the protruding annular abutment 9 is engaged by a resilient deformation of the base of the sheath 8 underneath the ring 5 of the neck 2.

As in the previous example, an annular space 16 is formed between base of the outer wall of the sheath 8 and inner wall of the lid 13, for accommodating a resilient deformation of this base of the sheath 8 during the setting in position and while it has already been itself previously put in position in the lid 13 for forming a pre-assembled assembly.

The setting in position of the sub-assembly by fitting on the neck 2 of the pot 1 is easy to carry out in a vacuum chamber, this setting in position necessitating only a feeding and fitting operation under a slight mechanical pressure. Likewise, it has been indicated in the foregoing disclosure that the pot 1 or other container is made of glass by molding. It is obvious that other materials can also be used, some synthetic materials being possibly convenient, particularly for cosmetic products, or even materials such as earthenware or porcelain. Moreover, the sheath can include a collar or a skirt providing for its tightness with a part of the neck different than the top.

I claim:

1. A tight closing device for a container having a neck, comprising a sheath of a synthetic material, said sheath having retainer members and including at least one protruding abutment for latching said sheath on the neck of the container and a fitting collar for engaging a portion of said neck, said sheath having a top provided with a sealing foil, wherein said sheath is fitted inside a lid including fixation means associated with said retainer members of said sheath so as to provide successive removal and setting in position operations of said lid independently of the sheath, wherein an annular space is defined between the sheath and the lid for accommodating resilient deformation of the protruding abutment, and wherein said neck is formed with a set of teeth cooperating with a set of ribs formed on the inner wall of the sheath.

2. The device as set forth in claim 1, wherein said lid has an inner wall with a lower end portion which defines an edge said edge being of a frustoconical or otherwise flare shape for defining said annular space accommodating the resilient deformation of the protruding abutment of the sheath during its fitting engagement onto the neck.

3. The device as set forth in claim 1, wherein said neck defines a flange above a groove for housing and retaining the protruding annular abutment of the sheath.

4. The device as set forth in claim 1, wherein the set of teeth of the neck are diametrically opposite, and wherein said neck comprises extra teeth which are offset but diametrically opposite each other, said extra teeth being formed by molding.

5. The device as set forth in claim 1, wherein said fitting collar of the sheath cooperates with a protruding ring formed at the top of the neck.

6. The device as set forth in claim 1, wherein said neck defines a protruding ring having a top with a chanfer formed before an inclined annular land and wherein the sheath forms, beyond the fitting collar, a re-entrant inner skirt ending in a bevel, whereby said skirt is resiliently deformed by the inclined annular land during fitting engagement of the sheath onto the neck.

7. The device as set forth in claim 1, wherein said ribs form stiffening members for an outer portion of the sheath and for the fitting collar.

8. The device as set forth in claim 3, wherein said flange formed by the neck has a top with a ramp cooperating with a ramp of the protruding annular abutment of the sheath during the fitting engagement of the sheath onto the neck.

9. The device as set forth in claim 1, wherein a periphery of the sealing foil is engaged inside a housing of the lid.

* * * * *